US006231255B1

(12) United States Patent
Tsai

(10) Patent No.: US 6,231,255 B1
(45) Date of Patent: May 15, 2001

(54) LIPSTICK HOUSING HAVING INCREASED STRENGTH

(76) Inventor: Yi Li Tsai, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/285,085

(22) Filed: Apr. 2, 1999

(51) Int. Cl.[7] ..... B43K 21/08
(52) U.S. Cl. ..... 401/78; 401/86; 401/98
(58) Field of Search ..... 401/78, 86, 98

(56) References Cited

U.S. PATENT DOCUMENTS 3,002,611 * 10/1961 Doblin ..... 401/78

FOREIGN PATENT DOCUMENTS

1489494 * 6/1967 (FR) ..... 401/78

* cited by examiner

*Primary Examiner*—Steven O. Douglas
*Assistant Examiner*—Peter deVore
(74) *Attorney, Agent, or Firm*—A & J

(57) ABSTRACT

A lipstick housing includes a barrel and a ferrule having a tube rotatably engaged in the barrel. The tube has one or more slots formed in the longitudinal direction. A seat is slidably received in the tube for holding a lipstick material and is guided to move along the tube when the tube is rotated relative to the barrel. The free end of the barrel includes a peripheral flange extended and curved radially inward and then extended downward for forming a reinforcing end portion and for preventing the barrel from being deformed by a user when the user holds the barrel.

1 Claim, 2 Drawing Sheets

LIPSTICK HOUSING HAVING INCREASED STRENGTH

BACKGROUND OF THE INVENTION

1. Field of the Invention

The present invention relates to a lipstick housing, and more particularly to a lipstick housing having an increased strength.

2. Description of the Prior Art

Typical lipsticks comprise a barrel, a tube rotatably received in the barrel, and a seat slidably received in the tube for receiving the lipstick material. The seat is to be moved along the tube for moving the lipstick material inward and outward of the barrel. The barrel is required to be held in place by one hand of the user when the other hand of the user rotates the tube. However, the barrel is weak and will be easily deformed inadvertently by the user.

The present invention has arisen to mitigate and/or obviate the afore-described disadvantages of the conventional lipstick housings.

SUMMARY OF THE INVENTION

The primary objective of the present invention is to provide a lipstick housing having an increased strength for preventing the lipstick housing from being deformed by the user.

In accordance with one aspect of the invention, there is provided a lipstick housing comprising a barrel, a ferrule includes a tube extended therefrom and rotatably engaged in the barrel, the tube including at least one slot formed therein, a seat slidably received in the tube for holding a lipstick material, and means for guiding the seat to move along the tube when the tube is rotated relative to the barrel. The barrel includes a free end having a peripheral flange extended and curved radially inward therefrom and extended downward for forming a reinforcing end portion and for preventing the barrel from being deformed by a user when the user holds the barrel.

The guiding means includes a cylindrical member secured in the barrel and having a helical groove form ed therein, the seat includes at least one projection extended therefrom and slidably received in the slot of the tube and slidably received in the helical groove of the cylindrical member for guiding the seat to move along the tube when the tube is rotated relative to the barrel.

The tube includes a radially inner diameter no less than that of the peripheral flange of the barrel for preventing the lipstick material from engaging with the peripheral flange of the barrel when the lipstick material is moved outward of the tube by rotating the tube relative to the barrel with the ferrule.

A cover is further provided and includes at least one rib extended downward therefrom for engaging with the peripheral flange of the barrel and for allowing the cover to be secured to the barrel with a force-fitted engagement.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
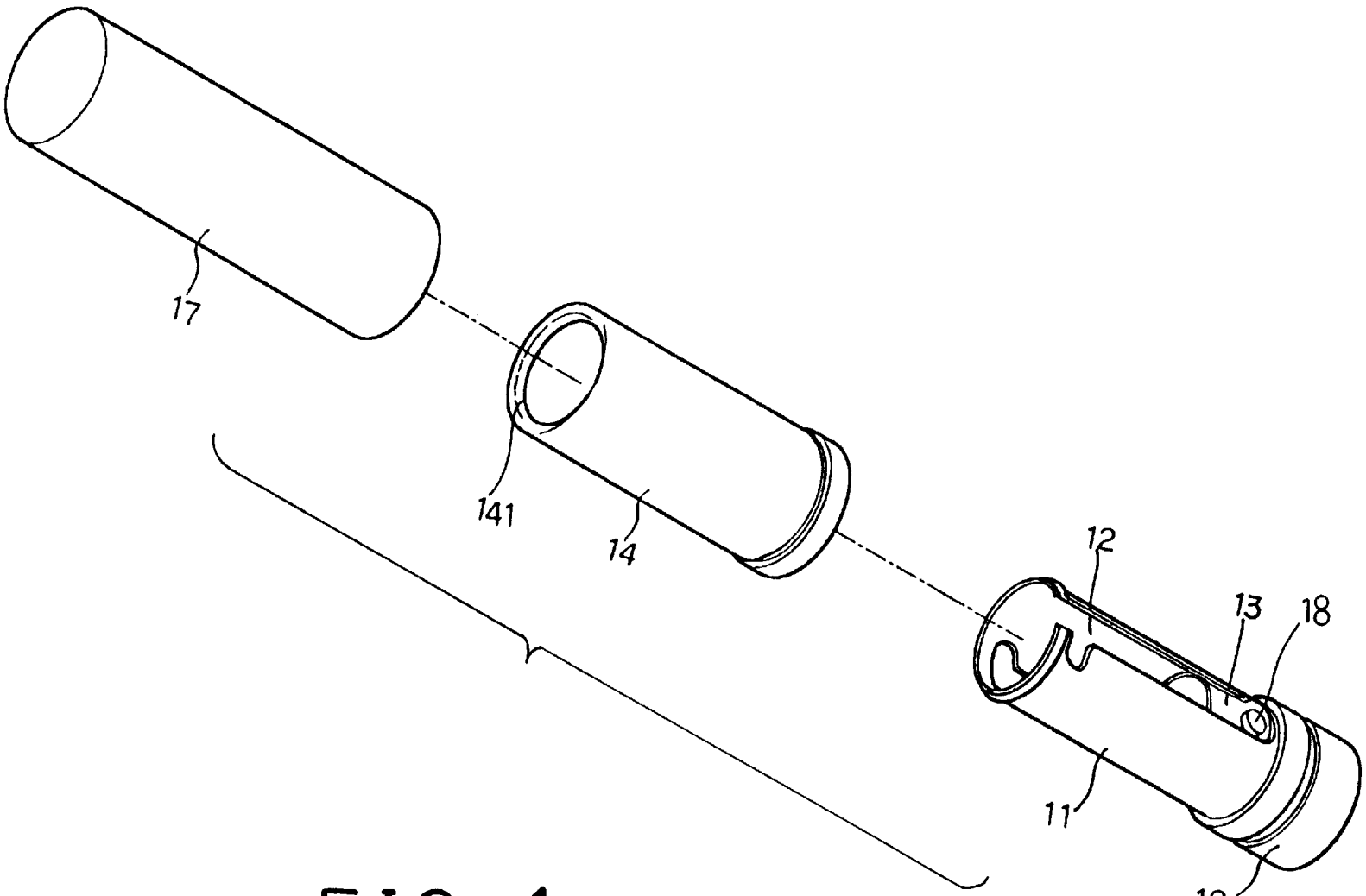
FIG. 1 is an exploded view of a lipstick housing in accordance with the present invention.
Figure 3:
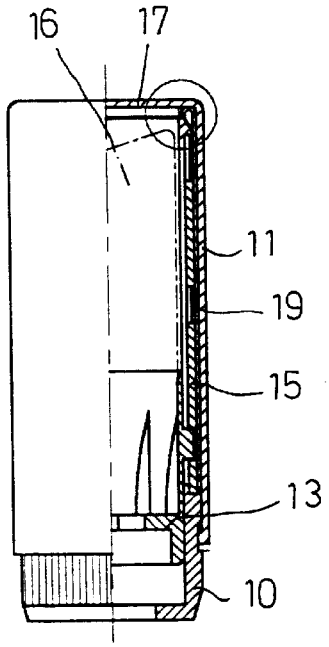
FIG. 3 is a partial cross sectional view of the lipstick housing.
Figure 2:
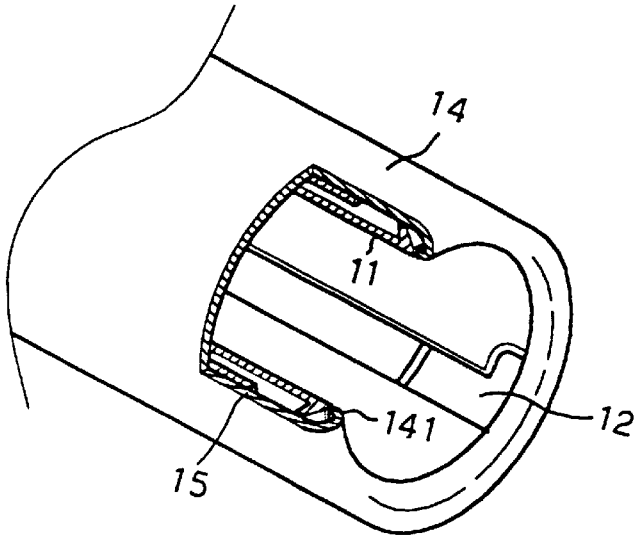
FIG. 2 is a partial perspective view of the lipstick housing.

Referring to the drawings, and initially to FIGS. 1–3, a lipstick housing in accordance with the present invention comprises a barrel 14, a ferrule 10 including a tube 11 rotatably received in the barrel 14, and a cover 17 engaged on the barrel 14. The tube 11 includes one or a pair of longitudinal slots 12 formed therein and preferably parallel to each other. A seat 13 is slidably received in the tube 11 for receiving the lipstick materials 16 (FIGS. 3, 4) and includes one or more projections 18 laterally extended outward for slidably engaged in the slots 12. The barrel 14 includes a cylindrical member 15 secured in the inner peripheral portion thereof. The cylindrical member 15 includes a helical groove 19 formed therein for slidably receiving the projections 18 of the seat 13 and for guiding the seat 13 to move along the tube 11 when the tube 11 is rotated relative to the barrel 14.

Figure 4:
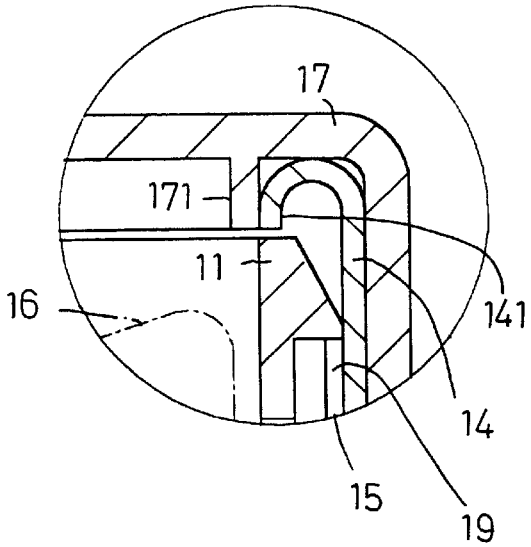
FIG. 4 is an enlarged partial cross sectional view of the lipstick housing.

As shown in FIGS. 1, 2 and 4, the barrel 14 includes a peripheral flange 141 extended and curved radially inward from a free end thereof and then extended downward for forming a reinforcing end portion and for preventing the barrel 14 from being deformed by the user when the user holds the barrel 14. The tube 11 includes a radially inner diameter no less than that of the peripheral flange 141 of the barrel 14 for preventing the lipstick material 16 from engaging with the peripheral flange 141 of the barrel 14 when the lipstick material 16 is moved outward by rotating the tube 11 with the ferrule 10. The cover 17 includes one or more ribs or includes a peripheral rib 171 extended downward for engaging with the peripheral flange 141 of the barrel 14 and for allowing the cover 17 to be secured to the barrel 14 by a force-fitted engagement. The cover 17 is preferably made of plastic material such that the peripheral rib 171 may include a suitable resilience for force-fitting to the peripheral flange 141 of the barrel 14.

Accordingly, the lipstick housing in accordance with the present invention includes an increased strength for preventing the lipstick housing from being deformed by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lipstick housing comprising:

a barrel including a free end having a peripheral flange extended and curved radially inward therefrom and extended downward for forming a reinforcing end portion and for preventing said barrel from being deformed by a user when the user holds said barrel;

a ferrule including a tube extended therefrom and rotatably engaged in the barrel, said tube including at least one slot formed therein, said tube including a radially inner diameter no greater than that of said peripheral flange of said barrel for preventing the lipstick material from engaging with said peripheral flange of said barrel when the lipstick material is moved outward of said tube by rotating said tube relative to said barrel with said ferrule;

a seat slidably received in said tube for holding a lipstick material;

means for guiding said seat to move along said tube when said tube is rotated relative to said barrel, said means including a cylindrical member secured in said barrel and having helical groove formed therein, said seat including at least one projection extended therefrom and slidably received in said at least one slot of said tube and slidably received in said helical groove of said cylindrical member for guiding said seat to move along said tube when said tube is rotated relative to said barrel; and a cover including at least one rib extended downward therefrom for engaging with said peripheral flange of said barrel and for allowing said cover to be secured to said barrel with a force-fitted engagement.

* * * * *